US012590376B2

(12) United States Patent
Kojima et al.

(10) Patent No.: US 12,590,376 B2
(45) Date of Patent: Mar. 31, 2026

(54) WATER ELECTROLYSIS SYSTEM AND CONTROL METHOD OF WATER ELECTROLYSIS SYSTEM

(71) Applicant: HONDA MOTOR CO., LTD., Tokyo (JP)

(72) Inventors: Shuichiro Kojima, Wako (JP); Shoji Takasugi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 837 days.

(21) Appl. No.: 17/891,168

(22) Filed: Aug. 19, 2022

(65) Prior Publication Data

US 2023/0064835 A1 Mar. 2, 2023

(30) Foreign Application Priority Data

Aug. 27, 2021 (JP) ..... 2021-139102

(51) Int. Cl.
*C25B 15/029* (2021.01)
*C25B 1/04* (2021.01)
(Continued)

(52) U.S. Cl.
CPC ..... *C25B 15/029* (2021.01); *C25B 1/04* (2013.01); *C25B 9/19* (2021.01); *C25B 15/08* (2013.01)

(58) Field of Classification Search
CPC .... C25B 1/04; C25B 9/05; C25B 9/23; C25B 9/19; C25B 15/029; C25B 15/08
See application file for complete search history.

(56) References Cited

U.S. PATENT DOCUMENTS

2002/0179456 A1* 12/2002 Yamashita ..... C23G 1/36 205/762
2018/0290904 A1 10/2018 Gardner
(Continued)

FOREIGN PATENT DOCUMENTS

CN 108130556 6/2018
CN 109072461 12/2018
(Continued)

OTHER PUBLICATIONS

Haleemah J. Mohammed, Nathera A. Ali; Fabricating and study effect of the concentrations electrolyte for an alkaline electrolysis cell. AIP Conf. Proc. Aug. 22, 2019; 2144 (1): 030002. (Year: 2019).*

(Continued)

*Primary Examiner* — Luan V Van
*Assistant Examiner* — Mofoluwaso S Jebutu
(74) *Attorney, Agent, or Firm* — Amin, Turocy & Watson, LLP

(57) ABSTRACT

A water electrolysis system includes a water supply unit, a KOH tank, a water electrolysis apparatus, and a control device. The water supply unit and the KOH tank supply an aqueous solution containing hydroxide ions of a predetermined concentration to a cathode of the water electrolysis apparatus. The water electrolysis apparatus includes a solid polymer electrolyte membrane, and a water electrolysis cell having an anode and a cathode provided on both sides of the solid polymer electrolyte membrane. The control device changes the voltage to increase while restricting a supply amount of a KOH aqueous solution to the cathode when a concentration of the KOH aqueous solution is higher than a predetermined reference concentration on the basis of information on correspondence between a voltage and current
(Continued)

between the anode and the cathode and the concentration of the KOH aqueous solution on the cathode.

3 Claims, 3 Drawing Sheets

(51) Int. Cl.
*C25B 9/19* (2021.01)
*C25B 15/08* (2006.01)

(56) References Cited

U.S. PATENT DOCUMENTS

| | | | |
|---|---|---|---|
| 2019/0106797 | A1 | 4/2019 | Caspersen et al. |
| 2020/0268292 | A1 | 8/2020 | Morgan et al. |
| 2021/0395911 | A1 | 12/2021 | Dukes et al. |
| 2022/0056594 | A1 | 2/2022 | Bulan et al. |

FOREIGN PATENT DOCUMENTS

| | | | | |
|---|---|---|---|---|
| CN | 111108374 | | 5/2020 | |
| CN | 112921338 | | 6/2021 | |
| CN | 113166952 | | 7/2021 | |
| EP | 3270456 | | 1/2018 | |
| EP | 3575444 | A1 * | 12/2019 | ..... C25B 15/00 |
| JP | 2001-246382 | | 9/2001 | |
| JP | 5184715 | | 4/2013 | |
| JP | 2015-223566 | | 12/2015 | |
| JP | 2019-178356 | | 10/2019 | |
| JP | 2019178356 | A * | 10/2019 | |
| JP | 2020-510136 | | 4/2020 | |
| WO | 2016/147720 | | 9/2016 | |
| WO | 2020/008687 | | 1/2020 | |

OTHER PUBLICATIONS

Jiangjin Liu, Zhenye Kang, Dongguo Li, Magnolia Pak, Shaun M. Alia, Cy Fujimoto, Guido Bender, Yu Seung Kim and Adam Z. Weber, Elucidating the Role of Hydroxide Electrolyte on Anion-Exchange-Membrane Water Electrolyzer Performance, May 19, 2021 J. Electrochem. Soc. 168 054522 (Year: 2021).*

Chinese Office Action for Chinese Patent Application No. 202210995727.2 mailed Mar. 25, 2025.

Liu Zhe et al, "Study on water electrolysis for producing hydrogen by water splitting with solutions in different concentration", 2013 International Industrial Design Seminar and Proceedings of the 18th National Industrial Design Academic Annual Conference, Oct. 12, 2013, pp. 135-139.

Japanese Office Action for Japanese Patent Application No. 2021-139102 mailed Jan. 24, 2023.

* cited by examiner

WATER ELECTROLYSIS SYSTEM AND CONTROL METHOD OF WATER ELECTROLYSIS SYSTEM

CROSS-REFERENCE TO RELATED APPLICATION

Priority is claimed on Japanese Patent Application No. 2021-139102, filed Aug. 27, 2021, the content of which is incorporated herein by reference.

BACKGROUND OF THE INVENTION

Field of the Invention

The present invention relates to a water electrolysis system and a control method of the water electrolysis system.

Description of Related Art

In the related art, for example, there is known a water electrolysis apparatus including an electrolyte membrane/electrode structure constituted by an electrolyte membrane formed of an anion exchange membrane configured to selectively conduct hydroxide ions (OM, and electrodes including an anode and a cathode (for example, see PCT International Publication No. 2016/147720). Such a water electrolysis apparatus electrolyzes water by supplying an aqueous solution containing hydroxide ions adjusted to a predetermined ion concentration to the cathode.

In the related art, for example, there is known an apparatus for adjusting an ion concentration using a pH meter configured to measure the pH of a solution (for example, see Japanese Unexamined Patent Application, First Publication No. 2015-223566).

SUMMARY OF THE INVENTION

During a normal operation of the above-mentioned water electrolysis apparatus, electrolysis of water can be appropriately continued by supplying an aqueous solution having a predetermined ion concentration set upon starting or the like to the cathode. However, when an operation state of the water electrolysis apparatus is changed, an amount of hydroxide ions moved to the anode, an amount of moisture generated on the anode, and the like, are changed. For example, when an ion concentration of the aqueous solution of the cathode is increased, corrosion of various components such as an electrolyte membrane/electrode structure, a pipeline, and the like, may occur, and commercial value may be deteriorated.

In consideration of the above-mentioned circumstances, an aspect according to the present invention is directed to providing a water electrolysis system and a control method of the water electrolysis system that are capable of suppressing decrease in efficiency of electrolysis of water and occurrence of abnormality due to corrosion of various components by appropriately adjusting an ion concentration of an aqueous solution supplied to an electrode.

In order to solve the above-mentioned problems and accomplish purposes related thereto, the present invention employs the following aspects.

(1) A water electrolysis system according to an aspect of the present invention includes a water electrolysis cell having an electrolyte membrane, and an anode and a cathode provided on both sides of the electrolyte membrane in a thickness direction, and configured to generate oxygen on the anode at a higher pressure than a pressure of an aqueous solution on the cathode while electrolyzing water of the aqueous solution supplied to the cathode by applying a voltage between the anode and the cathode; a power supply configured to apply the voltage between the anode and the cathode; an aqueous solution supply source configured to supply the aqueous solution containing hydroxide ions of a predetermined concentration to the cathode; and a control device configured to change the voltage to increase while restricting a supply amount of the aqueous solution to the cathode when a concentration of the hydroxide ions of the aqueous solution acquired on the basis of information on a predetermined correspondence among the voltage and the current between the anode and the cathode and the concentration of the hydroxide ions of the aqueous solution of the cathode is greater than a predetermined reference concentration.

(2) A water electrolysis system according to an aspect of the present invention includes a water electrolysis cell having an electrolyte membrane, and an anode and a cathode provided on both sides of the electrolyte membrane in a thickness direction, and configured to generate oxygen of a higher pressure on the anode than a pressure of an aqueous solution on the cathode while electrolyzing water of the aqueous solution supplied to the cathode by applying a voltage between the anode and the cathode; a power supply configured to apply the voltage between the anode and the cathode; an aqueous solution supply source configured to supply the aqueous solution containing hydroxide ions of a predetermined concentration to the cathode; a flow rate restricting unit configured to restrict a flow rate of oxygen in a flow channel for the oxygen discharged from the anode; and a control device configured to restrict the flow rate of the oxygen discharged from the anode using the flow rate restricting unit when a concentration of the hydroxide ions of the aqueous solution acquired on the basis of information on predetermined correspondence among the voltage and the current between the anode and the cathode and the concentration of the hydroxide ions of the aqueous solution of the cathode is greater than a predetermined reference concentration.

(3) In the aspect (1) or (2), the control device may change the concentration of the hydroxide ions of the aqueous solution to correspond to a state change of the water electrolysis cell after setting the concentration of the hydroxide ions of the aqueous solution to correspond to a predetermined operation mode of the water electrolysis cell.

(4) A control method of a water electrolysis system according to an aspect of the present invention is a control method executed by electronic equipment of a water electrolysis system including: a water electrolysis cell having an electrolyte membrane, and an anode and a cathode provided on both sides of the electrolyte membrane in a thickness direction, and configured to generate oxygen of a higher pressure on the anode than a pressure of an aqueous solution on the cathode while electrolyzing water of the aqueous solution supplied to the cathode by applying a voltage between the anode and the cathode; a power supply configured to apply the voltage between the anode and the cathode; an aqueous solution supply source configured to supply the aqueous solution containing hydroxide ions of a predetermined concentration to the cathode; a flow rate restricting unit configured to restrict a flow rate of oxygen in a flow channel for the oxygen discharged from the anode; and the electronic equipment, the control method of the water electrolysis system operated by the electronic equipment including: an acquisition step of acquiring a concentration of the hydroxide ions of the aqueous solution corresponding to an acquisition value of each of the voltage and the current on the basis of information on predetermined correspondence between the voltage and the current of the anode and the cathode and the concentration of the hydroxide ions of the aqueous solution; and a change step of changing an operation state of the water electrolysis system to decrease the concentration of the hydroxide ions of the aqueous solution when the concentration of the hydroxide ions of the aqueous solution acquired by the acquisition step is higher than a predetermined reference concentration range corresponding to a predetermined combination of the voltage and the current, or increase the concentration of the hydroxide ions of the aqueous solution when the concentration of the hydroxide ions of the aqueous solution acquired by the acquisition step is lower than the predetermined reference concentration range.

According to the aspect (1), when the concentration of the hydroxide ions on the cathode is higher than the predetermined reference concentration, the concentration of the hydroxide ions on the cathode can be appropriately adjusted by providing the control device configured to increase the voltage of the water electrolysis cell while restricting the supply amount of the aqueous solution to the cathode. The control device can suppress a decrease in efficiency of electrolysis of water and occurrence of abnormality due to corrosion of various components by appropriately adjusting the ion concentration of the aqueous solution supplied to the water electrolysis cell.

The control device can perform, for example, adjustment of the concentration of the aqueous solution supplied to the cathode more rapidly than in the case in which concentration adjustment is performed by a concentration adjustment device located upstream from the water electrolysis cell according to the operation state because the concentration of the hydroxide ions on the cathode is adjusted by changing the operating conditions of the water electrolysis system.

The control device can acquire the concentration of the hydroxide ions on the cathode on the basis of the voltage and the current of the water electrolysis cell, and can suppress increase in costs being incurred for a system configuration without requiring an additional sensor configured to measure an ion concentration, for example, a water level sensor, a pH sensor, and the like. Since the concentration of the hydroxide ions according to the voltage and the current of the water electrolysis cell can accurately show the concentration in the vicinity of the cathode, reliability and accuracy of the concentration adjustment can be improved.

According to the aspect (2), when the concentration of the hydroxide ions on the cathode is higher than the predetermined reference concentration, the concentration of the hydroxide ions on the cathode can be appropriately adjusted by providing the control device configured to restrict a flow rate of oxygen discharged from the anode by the flow rate restricting unit. The control device can suppress a decrease in efficiency of the electrolysis of the water and occurrence of abnormality due to corrosion of various components by appropriately adjusting the ion concentration of the aqueous solution supplied to the water electrolysis cell.

The control device can perform, for example, adjustment of the concentration of the aqueous solution supplied to the cathode more rapidly than in the case in which concentration adjustment is performed by a concentration adjustment device located upstream from the water electrolysis cell according to the operation state because the concentration of the hydroxide ion on the cathode is adjusted by changing the operating condition of the water electrolysis system.

The control device can acquire the concentration of the hydroxide ions on the cathode on the basis of the voltage and the current of the water electrolysis cell, and can suppress an increase in costs requires for a system configuration without requiring an additional sensor configured to measure the ion concentration, for example, a water level sensor, a pH sensor, and the like. Since the concentration of the hydroxide ions according to the voltage and the current of the water electrolysis cell accurately shows the concentration in the vicinity of the cathode, reliability and accuracy of the concentration adjustment can be improved.

In the case of the aspect (3), for example, even when the state change of the water electrolysis cell from the predetermined operation mode such as a normal output operation or the like occurs, the concentration of the hydroxide ions can be appropriately changed and stabilized to correspond to the state change of the water electrolysis cell.

According to the aspect (4), when the concentration of the hydroxide ions on the cathode is not within the predetermined reference concentration range, the concentration of the hydroxide ions on the cathode can be appropriately adjusted by changing the operation state of the water electrolysis system. By appropriately adjusting the ion concentration of the aqueous solution supplied to the water electrolysis cell, it is possible to suppress a decrease in efficiency of the electrolysis of the water and occurrence of abnormality due to corrosion of various components.

The concentration of the hydroxide ions on the cathode can be acquired on the basis of the voltage and the current of the water electrolysis cell, and the increase in costs required for the system configuration can be suppressed without requiring an additional sensor configured to measure an ion concentration, for example, a water level sensor, a pH sensor, and the like. Since the concentration of the hydroxide ions according to the voltage and the current of the water electrolysis cell accurately shows the concentration in the vicinity of the cathode, reliability and accuracy of the concentration adjustment can be improved.

DETAILED DESCRIPTION OF THE INVENTION

Hereinafter, a water electrolysis system of an embodiment of the present invention and a control method of the water electrolysis system will be described with reference to the accompanying drawings.

Figure 1:
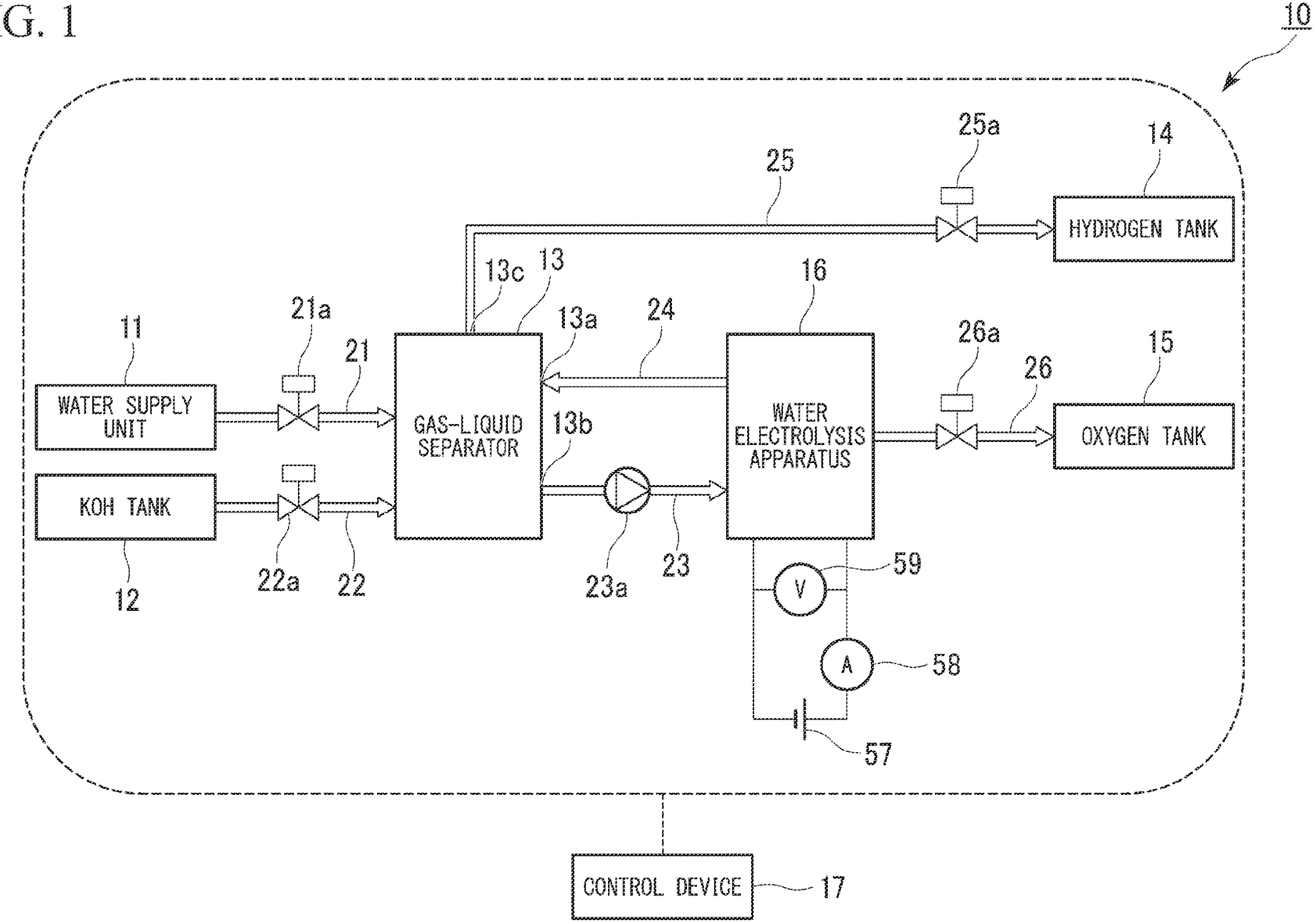
FIG. 1 is a view schematically showing a configuration of a water electrolysis system of an embodiment of the present invention.

FIG. 1 is a view schematically showing a configuration of a water electrolysis system 10 of the embodiment.

As shown in FIG. 1, the water electrolysis system 10 of the embodiment includes, for example, a water supply unit 11, a KOH tank 12, a gas-liquid separator 13, a hydrogen tank 14, an oxygen tank 15, a water electrolysis apparatus 16, and a control device 17.

The water supply unit 11 is connected to the gas-liquid separator 13 by a water supply flow channel 21. The water supply unit 11 includes, for example, a pure water generator configured to generate pure water from tap water or the like, a pump configured to send water to the gas-liquid separator 13, and the like. The water supply unit 11 supplies water to the gas-liquid separator 13 via a valve 21*a* or the like provided in the water supply flow channel 21.

The KOH tank 12 is connected to the gas-liquid separator 13 by a KOH supply flow channel 22. The KOH tank 12 stores an aqueous solution of potassium hydroxide (KOH). The KOH tank 12 supplies the aqueous solution of potassium hydroxide (KOH) to the gas-liquid separator 13 via a valve 22*a* or the like provided in the KOH supply flow channel 22.

The gas-liquid separator 13 is connected to the water electrolysis apparatus 16 by a supply flow channel 23 and a discharge flow channel 24, and connected to the hydrogen tank 14 by a hydrogen supply flow channel 25.

The gas-liquid separator 13 separates a fluid including hydrogen and non-reacted water supplied via the discharge flow channel 24 through a supply port 13*a* from the water electrolysis apparatus 16 into a gas component and a liquid component. The gas component includes, for example, hydrogen and vapor. The liquid component includes, for example, an aqueous solution of water and potassium hydroxide (KOH).

The gas-liquid separator 13 supplies the aqueous solution of water and potassium hydroxide (KOH) obtained through gas-liquid separation to the water electrolysis apparatus 16 via a pump 23*a* or the like provided in the supply flow channel 23 through a liquid discharge port 13*b* together with the aqueous solution of water and potassium hydroxide (KOH) supplied from the water supply unit 11 and the KOH tank 12.

The gas-liquid separator 13 separates the hydrogen and vapor of the gas component obtained through gas-liquid separation by supplying them to a vapor separator provided in the hydrogen supply flow channel 25 through, for example, a gas discharge port 13*c*. The gas-liquid separator 13 supplies the hydrogen separated from the gas component to the hydrogen tank 14 via a valve 25*a* or the like provided in the hydrogen supply flow channel 25.

The water electrolysis apparatus 16 is connected to the oxygen tank 15 by an oxygen supply flow channel 26. The water electrolysis apparatus 16 separates the oxygen and vapor generated by an anode 53, which will be described below, for example, by supplying them to the vapor separator provided in the oxygen supply flow channel 26. The water electrolysis apparatus 16 supplies the oxygen obtained by separation to the oxygen tank 15 via a valve 26*a* or the like provided in the oxygen supply flow channel 26.

The vapor separator provided in each of the hydrogen supply flow channel 25 and the oxygen supply flow channel 26 separates vapor from the fluid including each of the hydrogen and oxygen, and the vapor through, for example, cooling, moisture adsorption, or the like.

Each of the valves 21*a*, 22*a*, 25*a* and 26*a* provided in the flow channels 21, 22, 25 and 26 is, for example, an electromagnetic valve, a motor-operated valve, a pneumatic valve, or the like, and opening/closing, an aperture, or the like, thereof is controlled by the control device 17.

The water electrolysis apparatus 16 is, for example, a solid polymer type water electrolysis apparatus. The water electrolysis apparatus 16 electrolyzes the water supplied from the water supply unit 11 via the water supply flow channel 21. The water electrolysis apparatus 16 supplies the hydrogen and oxygen generated by electrolysis of the water to the hydrogen tank 14 and the oxygen tank 15.

The water electrolysis apparatus 16 includes at least one water electrolysis stack. The water electrolysis stack includes a plurality of water electrolysis cells 41 that are stacked, and a pair of end plates (not shown) configured to sandwich a stacked body (cell unit) of the plurality of water electrolysis cells 41 from both sides in a stacking direction.

Figure 2:
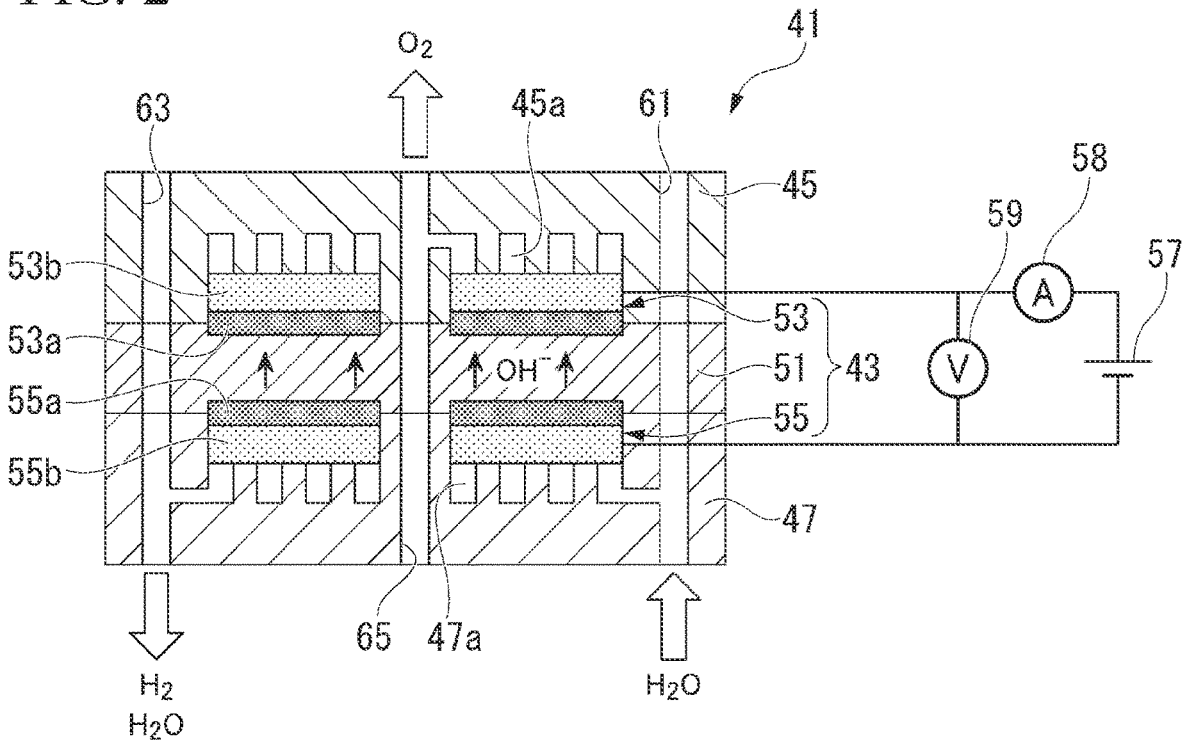
FIG. 2 is a cross-sectional view showing a configuration of a water electrolysis cell of a water electrolysis apparatus of the embodiment of the present invention.

FIG. 2 is a cross-sectional view showing a configuration of a water electrolysis cell 41 of the water electrolysis apparatus 16 according to the embodiment. As shown in FIG. 2, the water electrolysis cell 41 includes an electrolyte electrode structure 43, and an anode-side separator 45 and a cathode-side separator 47 that sandwich the electrolyte electrode structure 43 from both sides in a thickness direction (i.e., the stacking direction of the cell units).

The electrolyte electrode structure 43 includes a solid polymer electrolyte membrane 51, and the anode 53 and a cathode 55 that sandwich the solid polymer electrolyte membrane 51 from both sides in the thickness direction.

The solid polymer electrolyte membrane 51 includes an anion exchange membrane configured to selectively conduct an anion such as a hydroxide ion ($OH^-$) or the like.

The anode 53 includes, for example, an anode catalyst 53*a*, and a gas diffusion layer 53*b* or the like that is a feeder body.

The cathode 55 includes, for example, a cathode catalyst 55*a*, and a gas diffusion layer 55*b* or the like that is a feeder body.

The gas diffusion layer 53*b* that is a feeder body of the anode 53 and the gas diffusion layer 55*b* that is a feeder body of the cathode 55 are connected to a power supply 57 constituted by, for example, a battery or the like.

The water electrolysis apparatus 16 includes a current sensor 58 configured to detect a current flowing through the anode 53 and the cathode 55 to output a signal of a detection value (current detection value), and a voltage sensor 59 configured to detect a voltage applied between the anode 53 and the cathode 55 to output a signal of a detection value (voltage detection value).

The anode-side separator 45 forms an anode-side flow channel 45*a* between the anode 53 and the anode-side separator 45. The anode-side flow channel 45*a* is formed by, for example, a concave groove formed on a surface of the anode-side separator 45, and a surface of the anode 53 that covers an opening end of the concave groove of the anode-side separator 45. The anode-side flow channel 45*a* communicates with an oxygen discharge through-hole 65, which will be described below.

The cathode-side separator 47 forms a cathode-side flow channel 47*a* between the cathode 55 and the cathode-side separator 47. The cathode-side flow channel 47*a* is formed by, for example, a concave groove formed on a surface of the cathode-side separator 47, and a surface of the cathode 55 that covers an opening end of the concave groove of the cathode-side separator 47. The cathode-side flow channel 47*a* is in communication with a water supply through-hole 61 and a hydrogen discharge through-hole 63, which will be described below.

The water supply through-hole 61, the hydrogen discharge through-hole 63 and the oxygen discharge through-hole 65 passing through in the stacking direction are formed in the water electrolysis stack constituted by the cell unit including the plurality of water electrolysis cells 41 and a pair of end plates.

The water supply through-hole 61 is in communication with the cathode-side flow channel 47*a* in the water electrolysis apparatus 16 while being in communication with the supply flow channel 23 outside the water electrolysis apparatus 16.

The hydrogen discharge through-hole 63 is in communication with the cathode-side flow channel 47*a* in the water electrolysis apparatus 16 while being in communication with the discharge flow channel 24 outside the water electrolysis apparatus 16.

The oxygen discharge through-hole 65 is in communication with the anode-side flow channel 45*a* in the water electrolysis apparatus 16 while being in communication with the oxygen supply flow channel 26 outside the water electrolysis apparatus 16. The water electrolysis cell 41 electrolyzes water as the current flows through the anode 53 and the cathode 55 by applying a voltage of the power supply 57 while supplying the water to the cathode 55 through so-called cathode feed. The water electrolysis cell 41 generates, for example, a higher pressure of oxygen on the anode 53, which is higher than the pressure of the aqueous solution on the cathode 55.

The cathode 55 generates hydrogen and hydroxide ions ($OH^-$) by electrolyzing the water supplied from the water supply through-hole 61 to the cathode-side flow channel 47*a*. The hydrogen generated on the cathode 55 is discharged from the cathode-side flow channel 47*a* to the hydrogen discharge through-hole 63 together with non-reacted water (unreacted water). The hydroxide ions generated on the cathode 55 are conducted by the solid polymer electrolyte membrane 51 and move to the anode 53.

The anode 53 generates oxygen and water using the hydroxide ion that conducts the solid polymer electrolyte membrane 51 from the cathode 55. The oxygen and water generated on the anode 53 are discharged from the anode-side flow channel 45*a* to the oxygen discharge through-hole 65.

As shown in FIG. 1, the control device 17 generally controls the water electrolysis system 10 as a whole. The control device 17 is a software functional part that is operated by executing a predetermined program using a processor such as a central processing unit (CPU) or the like. The software function part is an electronic control unit (ECU) including a processor such as a CPU or the like, a read only memory (ROM) in which a program is stored, a random access memory (RAM) configured to temporarily store data, and an electronic circuit such as a timer or the like. At least a part of the control device 17 may be an integrated circuit such as a large scale integration (LSI) or the like.

The control device 17 adjusts a concentration of the aqueous solution of the potassium hydroxide (KOH) on the cathode 55 on the basis of a correlation between efficiency of the electrolysis of the water by the water electrolysis apparatus 16 and an ion concentration of the hydroxide ion ($OH^-$) on the cathode 55 of the water electrolysis cell 41. The efficiency of the electrolysis of the water by the water electrolysis apparatus 16 will be described according to the correlation between the voltage (V) and the current (I) between the anode 53 and the cathode 55, so-called I-V characteristics.

Figure 3:
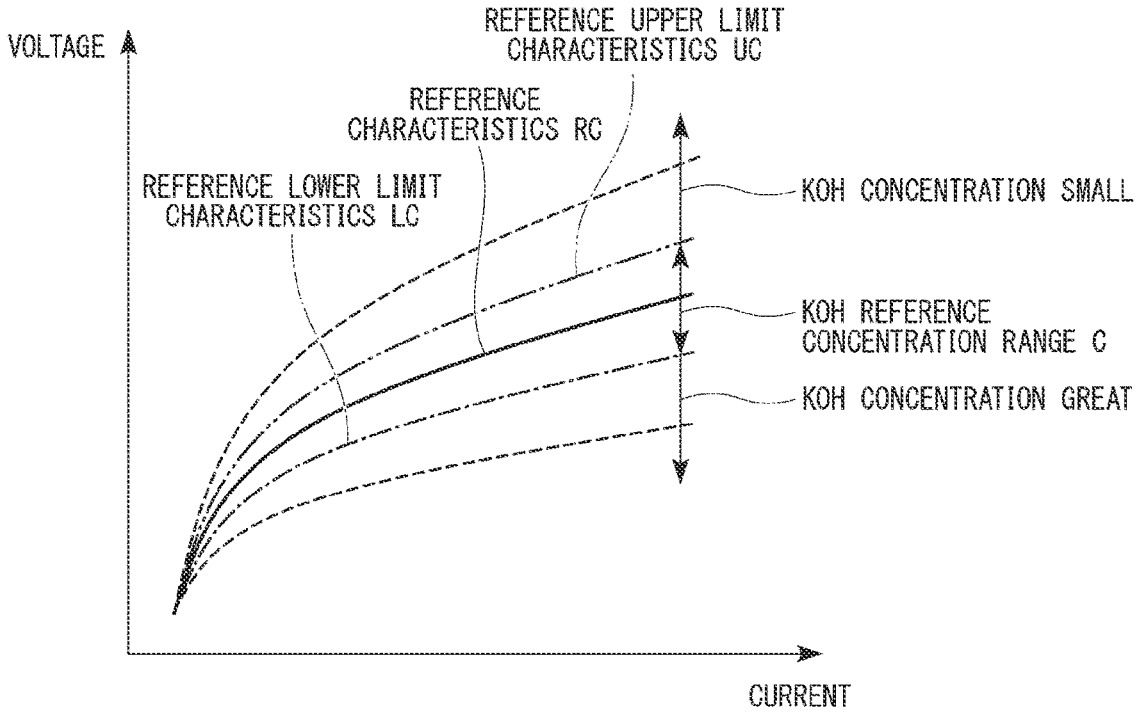
FIG. 3 is a view showing an example of correspondence between a voltage and a current between an anode and a cathode and a concentration of a KOH aqueous solution of the cathode in the water electrolysis apparatus of the embodiment of the present invention.

FIG. 3 is a view showing an example of correspondence between the voltage and the current between the anode 53 and the cathode 55 and the concentration of the KOH aqueous solution of the cathode 55 in the water electrolysis apparatus 16 of the embodiment.

As shown in FIG. 3, in the I-V characteristics of the water electrolysis apparatus 16, the voltage varies in an increasing tendency according to an increase in current. For example, the efficiency of the electric power is increased by decreasing the voltage as the concentration of the KOH aqueous solution (i.e., the ion concentration of the hydroxide ion ($OH^-$)) is increased with respect to the appropriate current, and the efficiency of the electric power is reduced by increasing the voltage as the concentration of the KOH aqueous solution is decreased.

The control device 17 stores information on correspondence between the I-V characteristics of the water electrolysis apparatus 16 and the concentration of the aqueous solution of the potassium hydroxide (KOH) on the cathode 55 according to, for example, map data or the like.

The control device 17 sets a predetermined reference concentration range C with respect to the concentration of the KOH aqueous solution on the cathode 55. The predetermined reference concentration range C is a concentration range required to secure desired water electrolysis efficiency while suppressing occurrence of abnormality due to corrosion of various components of the system according to the increase in concentration of the KOH aqueous solution that is, for example, a strong alkali solution. The control device 17 stores information on the reference characteristics range that is a combination of the current and the voltage corresponding to the predetermined reference concentration range C of the aqueous solution of the potassium hydroxide (KOH). The reference characteristics range is, for example, a range including predetermined reference characteristics RC in the I-V characteristics of the water electrolysis apparatus 16, which is a range between reference lower limit characteristics LC and reference upper limit characteristics UC.

The control device 17 acquires each of the detection values output from the current sensor 58 and the voltage sensor 59, and acquires a concentration of the KOH aqueous solution corresponding to the combination of the current detection value and the voltage detection value by referring information on the correspondence between the I-V characteristics that is previously stored and the concentration of the KOH aqueous solution. The control device 17 determines whether the concentration of the KOH aqueous solution corresponding to the combination between the current detection value and the voltage detection value is within the predetermined reference concentration range C. For example, the control device 17 compares the magnitude of the voltage value (reference voltage value) and the voltage detection value in the reference characteristics range corresponding to the current detection value, or compares the magnitude of the current value (reference current value) and the current detection value in the reference characteristics range corresponding to the voltage detection value.

The control device 17 controls the water electrolysis system 10 to reduce the concentration of the KOH aqueous solution (i.e., the ion concentration of the hydroxide ion ($OH^-$)) when the concentration of the KOH aqueous solution corresponding to the combination of the current detection value and the voltage detection value is greater than the predetermined reference concentration range C. The control device 17 controls the water electrolysis system 10 to increase the concentration of the KOH aqueous solution (i.e., the ion concentration of the hydroxide ion ($OH^-$)) when the concentration of the KOH aqueous solution corresponding to the combination of the current detection value and the voltage detection value is smaller than the predetermined reference concentration range C.

For example, the control device 17 changes the voltage to increase while restricting the supply amount of the KOH aqueous solution to the cathode 55 when the concentration of the KOH aqueous solution corresponding to the combination of the current detection value and the voltage detection value is greater than the predetermined reference concentration range C. The control device 17 promotes heat generation of the solid polymer electrolyte membrane 51 according to the increase in energization quantity by increasing the voltage between the anode 53 and the cathode 55. The control device 17 suppresses cooling of the solid polymer electrolyte membrane 51 due to the KOH aqueous solution by restricting (for example, reducing) the supply amount of the KOH aqueous solution to the cathode 55. The control device 17 increases the film thickness of the solid polymer electrolyte membrane 51 through thermal expansion by promoting heat generation of the solid polymer electrolyte membrane 51 and suppressing the cooling. According to the increase in film thickness of the solid polymer electrolyte membrane 51, movement of the hydroxide ion ($OH^-$) that conducts the solid polymer electrolyte membrane 51 from the cathode 55 toward the anode 53 is decreased. The control device 17 suppresses an increase in ion concentration of the hydroxide ion ($OH^-$) on the cathode 55 by decreasing the amount of moisture lost from the cathode 55.

Meanwhile, the control device 17 changes the voltage to decrease while not restricting (for example, increasing) the supply amount of the KOH aqueous solution to the cathode 55 when the concentration of the KOH aqueous solution corresponding to the combination of the current detection value and the voltage detection value is smaller than the predetermined reference concentration range C.

Next, a control method of the water electrolysis system 10 according to the embodiment, i.e., a control operation executed by the control device 17 will be described.

Figure 4:
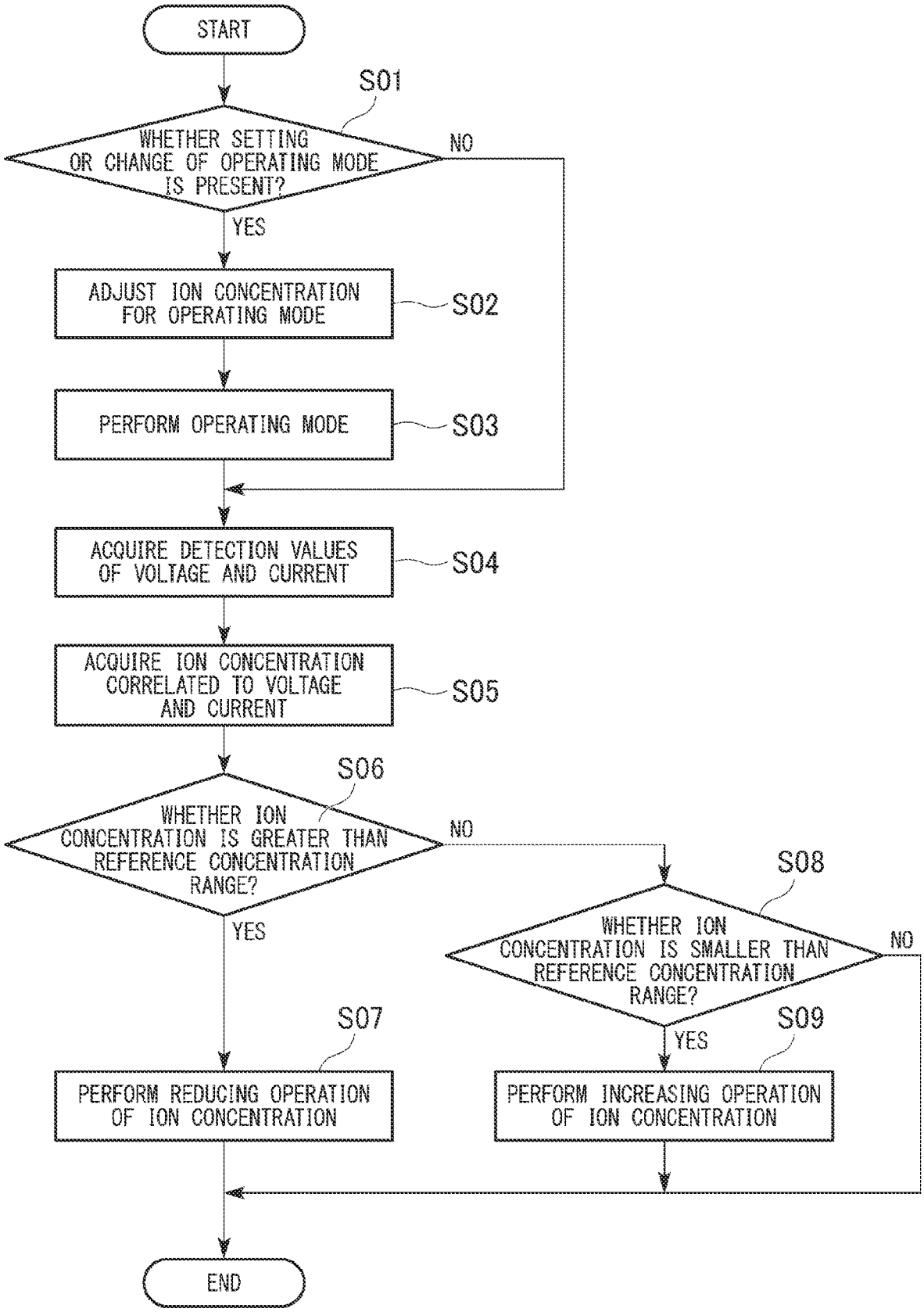
FIG. 4 is a flowchart showing a control method of the water electrolysis system of the embodiment of the present invention.

FIG. 4 is a flowchart showing the control method of the water electrolysis system 10 according to the embodiment. As shown in FIG. 4, a series of processing from step S01 to step S09 is executed at appropriate timing such as a predetermined period or the like.

First, in step S01, the control device 17 determines whether setting or change of the operation mode of the water electrolysis system 10 is present or not. The setting or change of the operation mode is executed at appropriate timing such as upon starting of the water electrolysis system 10 or upon operation continuation. The operation mode includes, for example, a predetermined normal output operation or the like.

When the determination result is "YES," the control device 17 advances the processing to step S02. Meanwhile, when the determination result is "NO," the control device 17 advances the processing to step S04. Next, in step S02, the control device 17 adjusts the concentration of the KOH aqueous solution (i.e., the ion concentration of the hydroxide ion ($OH^-$)) in a state in which the water and the KOH aqueous solution are supplied to the cathode 55 of the water electrolysis apparatus 16 according to the operation mode to be performed. For example, the control device 17 controls the voltage and the current between the anode 53 and the cathode 55 on the basis of the information on the correspondence between the I-V characteristics of the water electrolysis apparatus 16 and the concentration of the aqueous solution of the potassium hydroxide (KOH) of the cathode 55.

Next, in step S03, the control device 17 performs the operation mode according to the setting or the change.

Next, in step S04, the control device 17 acquires a current detection value and a voltage detection value from the current sensor 58 and the voltage sensor 59 while the predetermined operation mode is performed.

Next, in step S05, the control device 17 acquires the concentration of the KOH aqueous solution (i.e., the ion concentration of the hydroxide ion ($OH^-$)) corresponding to the combination of the current detection value and the voltage detection value by referring to the information on the correspondence between the I-V characteristics that are previously stored and the concentration of the KOH aqueous solution.

Next, in step S06, the control device 17 determines whether the concentration of the KOH aqueous solution corresponding to the combination of the current detection value and the voltage detection value is greater than the predetermined reference concentration range C. When the determination result is "YES," the control device 17 advances the processing to step S07. When the determination result is "NO," the control device 17 advances the processing to step S08. Then, in step S07, the control device 17 controls the water electrolysis system 10 to reduce the concentration of the KOH aqueous solution (i.e., the ion concentration of the hydroxide ion ($OH^-$)). For example, the control device 17 changes the voltage to increase while restricting the supply amount of the KOH aqueous solution to the cathode 55. Then, the control device 17 advances the processing to the end.

Next, in step S08, the control device 17 determines whether the concentration of the KOH aqueous solution corresponding to the combination of the current detection value and the voltage detection value is smaller than the predetermined reference concentration range C. When the determination result is "YES," the control device 17 advances the processing to step S09. Meanwhile, when the determination result is "NO," the control device 17 advances the processing to the end.

Then, in step S09, the control device 17 controls the water electrolysis system 10 to increase the concentration of the KOH aqueous solution (i.e., the ion concentration of the hydroxide ion ($OH^-$)). For example, the control device 17 changes the voltage to decrease while not restricting the supply amount of the KOH aqueous solution to the cathode 55. Then, the control device 17 advances the processing to the end.

As described above, according to the water electrolysis system 10 and the control method of the water electrolysis system 10 of the embodiment, for example, even when the state change of the water electrolysis cell 41 from the predetermined operation mode of the normal output operation or the like occurs, the concentration of the hydroxide ion can be appropriately changed and stabilized to correspond to the state change of the water electrolysis cell 41.

For example, when the concentration of the KOH aqueous solution on the cathode 55 is higher than the predetermined reference concentration range C, the concentration of the hydroxide ion on the cathode 55 can be appropriately adjusted by providing the control device 17 that increases the voltage of the water electrolysis cell 41 while restricting the supply amount of the KOH aqueous solution to the cathode 55. The control device 17 can suppress a decrease in efficiency of the electrolysis of the water and occurrence of abnormality due to corrosion of various components by appropriately adjusting the concentration of the KOH aqueous solution supplied to the water electrolysis cell 41.

The control device 17 can perform concentration adjustment more rapidly than in the case in which, for example, the concentration of the KOH aqueous solution supplied to the cathode 55 is adjusted by the concentration adjustment device located upstream from the water electrolysis cell 41 because the concentration of the hydroxide ion on the cathode 55 is adjusted by changing the operating condition of the water electrolysis system 10.

The control device 17 can acquire the concentration of the KOH aqueous solution (i.e., the ion concentration of the hydroxide ion) on the cathode 55 on the basis of the voltage and the current of the water electrolysis cell 41, and can suppress an increase in costs required for a system configuration without requiring an additional sensor configured to measure an ion concentration, for example, a water level sensor, a pH sensor, and the like. Since the concentration of the hydroxide ion according to the voltage and the current of the water electrolysis cell 41 can accurately show the concentration in the vicinity of the cathode 55, reliability and accuracy of the concentration adjustment can be improved.

(Variant)

Hereinafter, a variant of the embodiment will be described. The same parts as those of the above-mentioned embodiment are designated by the same reference signs, and description thereof will be omitted or simplified.

While the control device 17 changes the voltage to increase while restricting the supply amount of the KOH aqueous solution to the cathode 55 when the concentration of the KOH aqueous solution corresponding to the combination of the current detection value and the voltage detection value is greater than the predetermined reference concentration range C in the above-mentioned embodiment, there is no limitation thereto.

For example, the control device 17 may restrict (for example, reduce) a flow rate of oxygen discharged from the anode 53 of the water electrolysis apparatus 16 toward the oxygen tank 15 via the oxygen supply flow channel 26 when the concentration of the KOH aqueous solution corresponding to the combination of the current detection value and the voltage detection value is greater than the predetermined reference concentration range C. The control device 17 increases, for example, a pressure of the oxygen on the side of the anode 53 of the solid polymer electrolyte membrane 51 by controlling the aperture of the valve 26*a* of the oxygen supply flow channel 26. According to the increase in pressure difference between the side of the anode 53 and the side of the cathode 55 of the solid polymer electrolyte membrane 51, movement of moisture generated on the anode 53 that conducts the solid polymer electrolyte membrane 51 is increased such that the moisture is pushed back toward the cathode 55. The control device 17 restricts an increase in ion concentration of the hydroxide ion ($OH^-$) on the cathode 55 by increasing the amount of moisture on the cathode 55.

Meanwhile, the control device 17 may increase the flow rate of the oxygen while not restricting (for example, increasing) the flow rate of the oxygen discharged from the anode 53 of the water electrolysis apparatus 16 toward the oxygen tank 15 via the oxygen supply flow channel 26 when the concentration of the KOH aqueous solution corresponding to the combination of the current detection value and the voltage detection value is smaller than the predetermined reference concentration range C.

While the water electrolysis system 10 includes the KOH tank 12 in the above-mentioned embodiment, there is no limitation thereto. The water electrolysis system 10 may include a tank configured to store another aqueous solution instead of the aqueous solution of the potassium hydroxide (KOH) in order to refill the hydroxide ion ($OH^-$) into the water supplied from the water supply unit 11.

While the control device 17 adjusts the concentration of the KOH aqueous solution by controlling the voltage and the current between the anode 53 and the cathode 55 to correspond to the operation mode to be performed in step S02 shown in FIG. 4 in the above-mentioned embodiment, there is no limitation thereto. For example, the water electrolysis system 10 may include a water level sensor, a pH sensor, and the like, configured to detect a water level and a pH of the aqueous solution of the potassium hydroxide (KOH) stored in the gas-liquid separator 13 or the like. For example, the control device 17 controls the flow rate of the water and the KOH aqueous solution supplied from the gas-liquid separator 13 to the cathode 55 of the water electrolysis apparatus 16 on the basis of the signal of the detection value output from the water level sensor and the pH sensor. The control device 17 can adjust the concentration of the KOH aqueous solution (i.e., the ion concentration of the hydroxide ion ($OH^-$)) on the cathode 55 by controlling the apertures of the valves 21*a* and 22*b* of the water supply flow channel 21 and the KOH supply flow channel 22.

Accordingly, re-adjustment of the concentration of the aqueous solution of the potassium hydroxide (KOH) stored in the gas-liquid separator 13 may be performed and control of the voltage and the current between the anode 53 and the cathode 55 may be released in a stage in which the potassium hydroxide (KOH) re-adjusted by the gas-liquid separator 13 is supplied to the cathode 55 while the concentration of the KOH aqueous solution is adjusted by controlling the voltage and the current between the anode 53 and the cathode 55 to correspond to the operation mode to be performed.

The embodiment of the present invention is presented as an example and is not intended to limit the scope of the present invention. These embodiments may be performed in various other forms, and various omissions, replacements, and changes may be made without departing from the spirit of the present invention. These embodiments and modifications thereof are included in the scope and spirit of the present invention and their equivalent scopes described in the scope of the claims as well as the scope and the spirit of the present invention.

What is claimed is:

1. A water electrolysis system comprising:

a water electrolysis cell having an electrolyte membrane, and an anode and a cathode provided on both sides of the electrolyte membrane in a thickness direction, and configured to generate oxygen of a higher pressure on the anode than a pressure of an aqueous solution on the cathode while electrolyzing water of the aqueous solution supplied to the cathode by applying a voltage between the anode and the cathode;

a power supply configured to apply the voltage between the anode and the cathode;

an aqueous solution supply source configured to supply the aqueous solution containing hydroxide ions of a predetermined concentration to the cathode; and a control device configured to change the voltage to increase while restricting a supply amount of the aqueous solution to the cathode so as to increase a film thickness of the electrolyte membrane through thermal expansion when a concentration of the hydroxide ions of the aqueous solution acquired on the basis of information on predetermined correspondence among the voltage and the current between the anode and the cathode and the concentration of the hydroxide ions of the aqueous solution of the cathode is greater than a predetermined reference concentration.

2. The water electrolysis system according to claim 1, wherein the control device changes the concentration of the hydroxide ions of the aqueous solution to correspond to a state change of the water electrolysis cell after setting the concentration of the hydroxide ions of the aqueous solution to correspond to a predetermined operation mode of the water electrolysis cell.

3. A control method executed by electronic equipment of a water electrolysis system comprising:

a water electrolysis cell having an electrolyte membrane, and an anode and a cathode provided on both sides of the electrolyte membrane in a thickness direction, and configured to generate oxygen of a higher pressure on the anode than a pressure of an aqueous solution on the cathode while electrolyzing water of the aqueous solution supplied to the cathode by applying a voltage between the anode and the cathode;

a power supply configured to apply the voltage between the anode and the cathode;

an aqueous solution supply source configured to supply the aqueous solution containing hydroxide ions of a predetermined concentration to the cathode;

a flow rate restricting unit configured to restrict a flow rate of oxygen in a flow channel for the oxygen discharged from the anode; and the electronic equipment, the control method of the water electrolysis system operated by the electronic equipment, comprising:

an acquisition step of acquiring a concentration of the hydroxide ions of the aqueous solution corresponding to an acquisition value of each of the voltage and the current on the basis of information on predetermined correspondence among the voltage and the current between the anode and the cathode and the concentration of the hydroxide ions of the aqueous solution of the cathode; and a change step of changing an operation state of the water electrolysis system to increase the voltage while restricting a supply amount of the aqueous solution to the cathode so as to increase a film thickness of the electrolyte membrane through thermal expansion when the concentration of the hydroxide ions of the aqueous solution acquired by the acquisition step is higher than a predetermined reference concentration range corresponding to a predetermined combination of the voltage and the current.

* * * * *